US010907439B2

(12) United States Patent
Stephenson et al.

(10) Patent No.: US 10,907,439 B2
(45) Date of Patent: Feb. 2, 2021

(54) APPARATUS AND METHOD FOR WELL TUBULAR FLOTATION

(71) Applicant: Deep Casing Tools, Ltd., Aberdeen (GB)

(72) Inventors: David Stephenson, Aberdeen (GB); Tomasz Jozef Walerianczyk, Tarnowiec (PL)

(73) Assignee: Deep Casing Tools, Ltd., Aberdeen (GB)

( * ) Notice: Subject to any disclaimer, the term of this patent is extended or adjusted under 35 U.S.C. 154(b) by 29 days.

(21) Appl. No.: 16/377,786

(22) Filed: Apr. 8, 2019

(65) Prior Publication Data

US 2019/0309600 A1 Oct. 10, 2019

Related U.S. Application Data

(60) Provisional application No. 62/655,364, filed on Apr. 10, 2018.

(51) Int. Cl.
*E21B 23/00* (2006.01)
*E21B 33/129* (2006.01)

(52) U.S. Cl.
CPC ..... *E21B 33/1293* (2013.01)

(58) Field of Classification Search
CPC .... E21B 17/012; E21B 33/1293; E21B 23/00; E21B 33/1291
See application file for complete search history.

(56) References Cited

U.S. PATENT DOCUMENTS

| | | | | |
|---|---|---|---|---|
| 9,593,542 | B2 * | 3/2017 | Getzlaf | E21B 17/08 |
| 10,208,564 | B2 * | 2/2019 | Ravensbergen | E21B 17/00 |
| 10,683,728 | B2 * | 6/2020 | Kellner | E21B 21/10 |

* cited by examiner

*Primary Examiner* — Catherine Loikith
(74) *Attorney, Agent, or Firm* — Richard A. Fagin

(57) ABSTRACT

A flotation device for a wellbore tubular has a flotation disk having a tapered exterior profile. A maximum external diameter of the flotation disk is such to enable free longitudinal movement within the wellbore tubular. A plurality of locking segments each has a tapered interior profile cooperatively engageable with the tapered exterior profile. Each locking segment has gripping elements on an exterior surface thereof to engage an inner wall of the wellbore tubular. The tapered exterior profile and the tapered interior profile cooperate to expand a diameter of the locking segments as profile engagement increases.

7 Claims, 2 Drawing Sheets

APPARATUS AND METHOD FOR WELL TUBULAR FLOTATION

CROSS REFERENCE TO RELATED APPLICATIONS

Priority is claimed from U.S. Provisional Application No. 62/655,364 filed on Apr. 10, 2018, which application is incorporated herein by reference in its entirety.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable.

BACKGROUND

This disclosure relates to the technical field of inserting or "running" well tubulars such as casing or liner into a wellbore drilled through subsurface formations. More specifically, the disclosure relates to devices used to maintain a particular fluid, or lack of fluid, within such tubulars to enhance buoyant movement of the tubulars into highly inclined or horizontal wellbores.

Wellbore completion techniques known in the art used in connection with highly inclined or horizontal sections of a wellbore include buoyant movement of a wellbore tubular into the highly inclined or horizontal section of such a wellbore. Once the movement is completed, low density fluid or vacuum sealed within the tubular is released and completion of the wellbore through such tubular may resume.

U.S. Pat. No. 7,549,479 issued to Biegler et al. is illustrative of known methods and apparatus for buoyant movement or "running" of wellbore tubulars. A method disclosed in the '479 patent comprises the following. A lower plug is attached at one end of a portion of a tubular conduit. This end is inserted into a wellbore. After insertion into the wellbore of the desired length of conduit, intended both to resist internal collapse forces and be substantially buoyant, a plug is attached at the upper end of the conduit. The plug has a valve designed to enable fluid communication between the pressurized fluid section and the insertion string. A pump is attached to the valve and pressurized fluid is added to the pressurized fluid section of the conduit, after which the valve is closed. After the tubular conduit is inserted to the desired depth, the valve is opened allowing the pressurized fluid flow out of the pressurized fluid section. Conventional well construction activities may then resume.

An important consideration in buoyant tubular running methods and apparatus is the manner in which fluid isolation is maintained between the interior of the tubular and the exterior of the tubular, and subsequent removal of such fluid isolation. There exists a need for improved fluid isolation devices used in buoyant running of tubulars and similar well construction functions.

In many casing float techniques and devices used in such techniques, it may not be possible to obtain full casing or liner ID (inside diameter) following the opening of the air chamber. It is desirable to obtain full casing or liner ID so that downhole tools can be conveyed to this portion of the casing string and so that operations, such as cementing, can be easily carried out using conventional ball-drop techniques, or other conventional techniques. Also, many float devices require the use of specialized float shoes and/or float collars.

It is desirable to have a flotation chamber (also referred to herein as a "float chamber" or "buoyant chamber") which is easy and relatively inexpensive to install on a casing or liner string and which can be used with conventional float equipment such as float shoes and float collars, and with conventional equipment such as landing collars and cementing plugs. Further, it is desirable for the parts of the float chamber to be easily removed from the wellbore and/or that the removal results in full casing ID so that various downhole operations could be readily performed following removal or opening of the buoyant chamber.

SUMMARY

A flotation device for a wellbore tubular according to one aspect of the present disclosure has a flotation disk having a tapered exterior profile. A maximum external diameter of the flotation disk is such to enable free longitudinal movement within the wellbore tubular. A plurality of locking segments each has a tapered interior profile cooperatively engageable with the tapered exterior profile. Each locking segment has gripping elements on an exterior surface thereof to engage an inner wall of the wellbore tubular. The tapered exterior profile and the tapered interior profile cooperate to expand a diameter of the locking segments as profile engagement increases.

In some embodiments, the interior and exterior tapered profiles are correspondingly threaded.

Some embodiments further comprise at least one elastomer ring circumscribing an exterior of the locking segments.

Some embodiments further comprise a seal ring disposed adjacent to the flotation disk on a side thereof exposed to higher pressure than an opposed side of the flotation disk.

A method for buoyantly moving a tubular into a wellbore according to another aspect of the present disclosure includes assembling a well tubular having a plug at a bottom end and moving the assembled tubular into a wellbore. At a selected position along the moved tubular, a floatation device is affixed to an interior wall of the moved tubular. The flotation device comprises a flotation disk having a tapered exterior profile. A maximum external diameter of the flotation disk is such that is enables free longitudinal movement of the flotation disk within the wellbore tubular. A plurality of locking segments each having a tapered interior profile is cooperatively engageable with the tapered exterior profile of the flotation disk. Each locking segment has gripping elements on an exterior surface thereof to engage an inner wall of the wellbore tubular. The exterior tapered profile and interior tapered profile cooperate to expand a diameter of the locking segments as profile engagement increases.

In some embodiments, the external and internal tapered profiles are correspondingly threaded. In such embodiments, the flotation disk is rotated to lock the flotation device in place.

DETAILED DESCRIPTION

Figure 1:
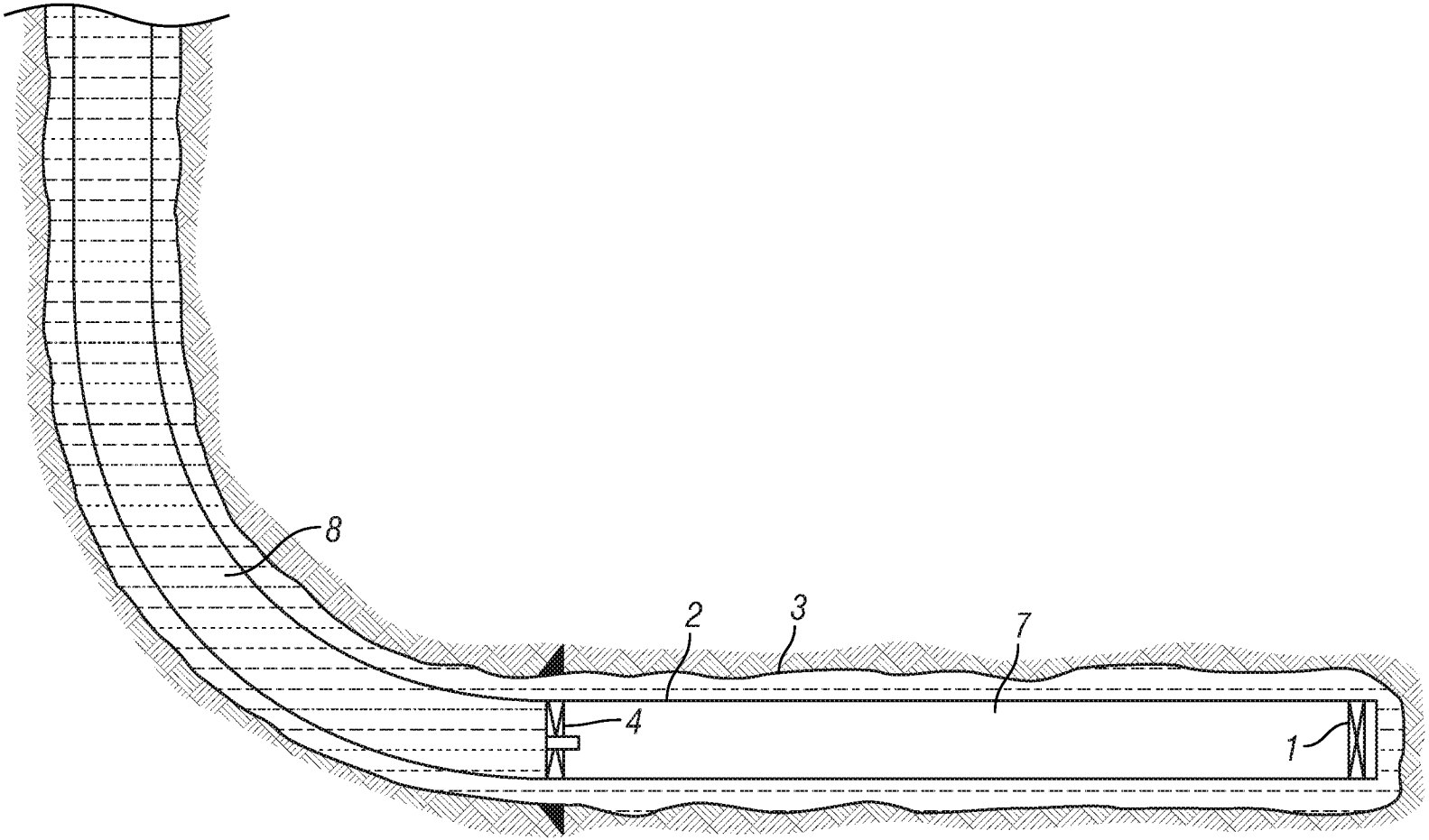
FIG. 1 shows running a casing or liner according to the present disclosure.

FIG. 1 illustrates buoyant running of a wellbore tubular or conduit such as a casing or liner according to the present disclosure. First, a lower plug 1 may be placed within or on the deepest part of the conduit 2, that is, the downhole end of the conduit. The lower plug may be placed, e.g., while this part of the conduit 2 is at the surface. The lower plug 1 may be an ordinary plug, a tubular toe or any equivalent device that can prevent fluid communication into the conduit 2 or out of the conduit 2. More segments or "joints" may be added to the conduit 2, onto the top most joint of the conduit 2 hanging in the wellbore 3 while the conduit 2 is inserted piecewise into a wellbore 3. Once an entire portion or section 7 of the conduit 2 that is to be sealed, e.g., pressurized, filled with low density fluid or evacuated, is hanging in the wellbore 3 from the surface, an upper plug 4 is inserted in the conduit 2. The upper plug 4 will be explained in more detail with reference to FIGS. 2 and 3. Then, a buoyant tubular may be obtained, e.g., by pressurizing, filling with low density fluid or evacuating in the section 7 of conduit between the lower plug 1 and the upper plug 4. In some embodiments, air or another fluid, e.g., drilling fluid 8, may be left in the conduit 2 as it is run into the wellbore 3. Then, once the upper plug 4 is inserted, the section 7 is fluidly isolated. The internal pressure of the conduit section 7 between the plugs 1 and 4 when pressurized may be performed to obtain a favorable conduit resistance to external collapse forces. It should be noted that the insertion of pressurized fluid, which may comprise foam or gas, into the section 7 of the conduit 2 may be performed external to the wellbore 3 or may be performed while the section 7 of the conduit 2 is at least partially exposed (protruding) from the wellbore 3.

Figure 2:
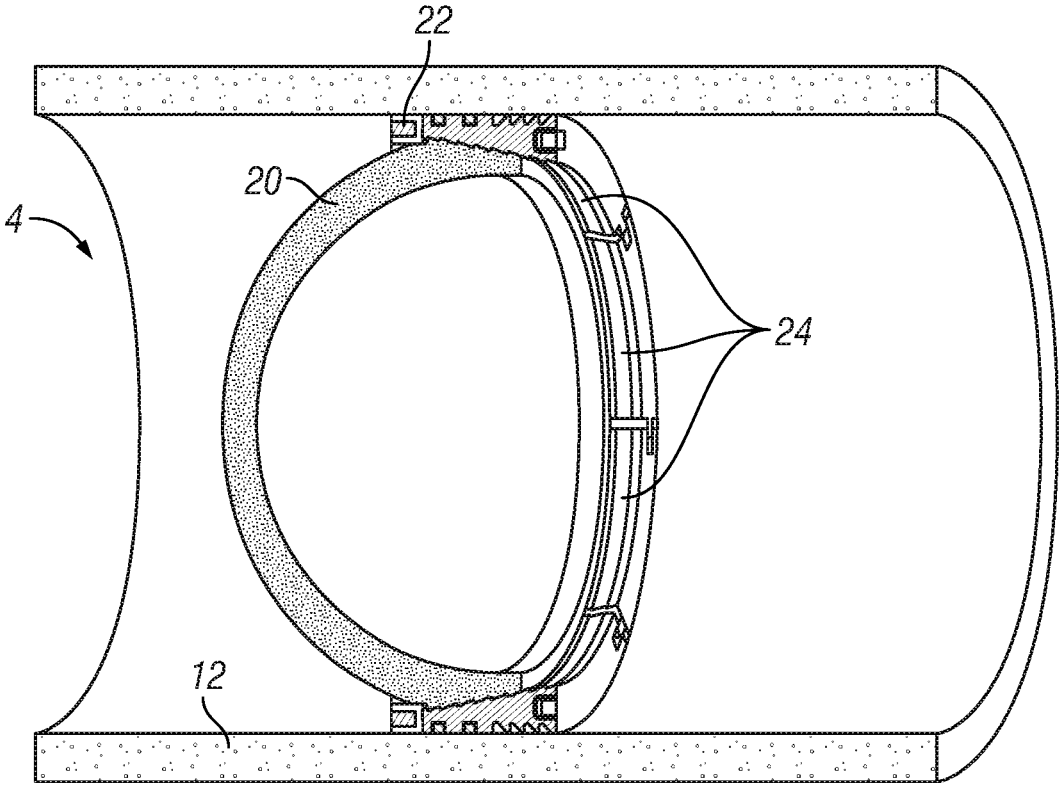
FIG. 2 shows a view of a tubular flotation disk and locking element.

FIG. 2 shows a cut away view of an example flotation device that can be affixed to any selected smooth wall portion of the interior of a wellbore tubular such as casing or liner, including the section (7 in FIG. 1). The flotation device 4, which serves the function of the upper plug as shown in FIG. 1, comprises a tubular segment 12 of wellbore tubular such as casing or liner. The tubular segment 12 may already be assembled, e.g., by threaded connection, to the tubular section (7 in FIG. 1). A flotation disk 20 may be of a type sold under the trade name MAGNUMDISK by Magnum Oil Tools International, Ltd., 5655 Bear Lane, Suite 100, Corpus Christi, Tex. 78405. The flotation disk 20 may have a tapered exterior profile on one side, as may be observed in FIG. 3. In some embodiments, the tapered exterior profile may be threaded. The flotation disk 20 may have a maximum external diameter to enable free fit and movement within the tubular segment 12, and may be locked in place in the tubular segment 12 using one or more locking segments 24. A ring seal 22, which may be made from elastomer, may be disposed proximate the circumference of the flotation disk 20 on the side thereof exposed to higher pressure, thereby to assist in excluding fluid movement across the flotation disk 20.

The one or more locking segments 24 collectively circumscribe the entire inner wall of the tubular segment 12. While one, full circumference locking segment would be suitable to retain the flotation disk 20 in position in the tubular segment 12, by having a plurality of locking segments 24, upon rupture of the flotation disk 20, no part of the locking segments 24 may be expected to remain affixed to the inner wall of the tubular segment 12. Such may provide full internal diameter after rupture of the flotation disk 20.

The internal surface of each the locking segments 24 is in contact with the flotation disk 20 to create a pressure barrier for denser fluid above it and less dense fluid below it.

Figure 3:
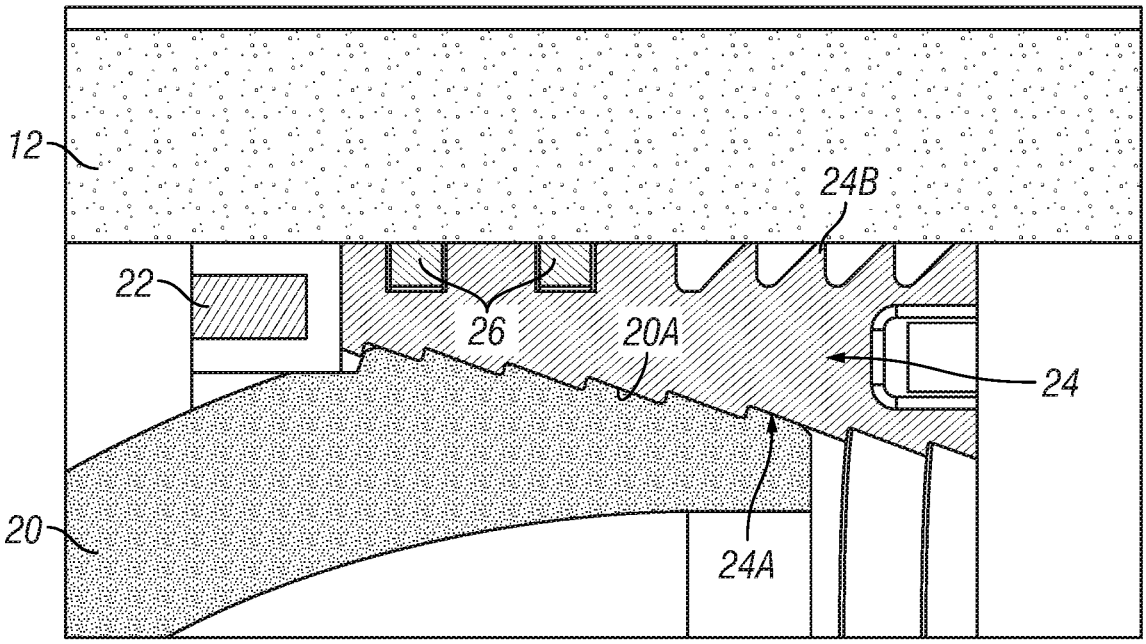
FIG. 3 shows a more detailed view of the flotation disk and locking element of FIG. 2.

One of the locking segments 24 is shown in expanded view in FIG. 3. The locking segment 24 may comprise dog or tooth shaped gripping elements 24B that grip the locking segment 24 in place against the inner wall of the tubular segment 12. The outer surface of the locking segment 24 may comprise one or more elastomer rings 26 seated in suitable recesses or grooves to provide additional longitudinal friction to retain the locking segment 24 in place. The interior surface of the locking segment 24 may comprise a tapered interior profile 24A that cooperatively engages the exterior tapered profile 20A on the exterior of the flotation disk 20. In some embodiments, the tapered interior profile 24A may be threaded. Thus, retaining force holding the locking segments 24 in place can be increased by increasing longitudinal engagement between the tapered interior profile 24A of the locking segments 24 and the tapered exterior profile 20A of the flotation disk 20. In embodiments having threads on such cooperating tapered profiles, retaining force may be increased by increasing corresponding thread engagement. Position and sealing mechanism of the ring seal 22 may be observed in FIG. 3. Gripping force between the locking segments 24 and the inner wall of the tubular segment 12 may be increased beyond that provided by initial engagement of the tapered profiles 24A, 20A by the action of fluid pressure against the flotation disk 20 (and thus expansion of the locking segments 24). In some embodiments, a taper angle of the corresponding tapered interior profile 24A on the locking segments 24 and the tapered interior profile 20A on the flotation disk 20 may be in a range of 1 to 30 degrees.

In operation, a wellbore tubular (conduit 2) may be inserted into a wellbore 3 as shown in FIG. 1 with the lower plug 1 in place. When the position at which the flotation device 4 is located is disposed at a convenient position, such as in a rig derrick, a plurality of the locking segments 24 and flotation disk 20 may be assembled and moved to a chosen position within the wellbore tubular (conduit 2). The flotation disk 20 may then be rotated to engage its threads with the tapered threads in the locking segments 24 until sufficient retaining force has been obtained. The ring seal 22 may then be applied. The wellbore tubular (conduit 2) may be inserted to its intended depth in the wellbore (3 in FIG. 1) and the flotation device 4 may then be removed for further operation in the wellbore tubular (conduit 2).

Although only a few examples have been described in detail above, those skilled in the art will readily appreciate that many modifications are possible in the examples. Accordingly, all such modifications are intended to be included within the scope of this disclosure as defined in the following claims.

What is claimed is:

1. A flotation device for a wellbore tubular, comprising:

a flotation disk having a tapered exterior profile, a maximum external diameter of the flotation disk being such to enable free longitudinal movement of the flotation disk within the wellbore tubular; and a plurality of locking segments each having a tapered interior profile cooperatively engageable with the tapered exterior profile of the flotation disk, each locking segment having gripping elements on an exterior surface thereof to engage an inner wall of the wellbore tubular in a constant diameter portion thereof;

wherein the tapered exterior profile and the tapered interior profile cooperate to expand a diameter of the locking segments as profile engagement increases, such that gripping force between the gripping elements and the wellbore tubular increases as fluid pressure applied to the flotation disk increases.

2. The device of claim 1 wherein the tapered exterior profile and the tapered interior profile comprise corresponding threads.

3. The device of claim 1 further comprising at least one elastomer ring circumscribing an exterior of the locking segments.

4. The device of claim 1 further comprising a seal ring disposed adjacent to the flotation disk on a side thereof exposed to higher pressure than an opposed side of the flotation disk.

5. A method for buoyantly moving a tubular into a wellbore, comprising:

assembling a well tubular having a plug at a bottom end and moving the assembled tubular into a wellbore;

at a selected position along the moved tubular, affixing a floatation device to an interior wall of the moved tubular, the flotation device comprising a flotation disk having a tapered exterior profile, a maximum external diameter of the flotation disk being such to enable free longitudinal movement of the flotation disk within the wellbore tubular, a plurality of locking segments each having a tapered interior profile cooperatively engageable with the tapered exterior profile of the flotation disk, each locking segment having gripping elements on an exterior surface thereof to engage an inner wall of the wellbore tubular, and wherein the tapered exterior profile and the tapered interior profile cooperate to expand a diameter of the locking segments as profile engagement increases, such that gripping force between the gripping elements and the wellbore tubular increases as fluid pressure applied to the flotation disk increases; and after affixing the flotation device, continuing moving the well tubular to a selected position within the wellbore.

6. The method of claim 5 wherein the tapered exterior profile and the tapered interior profile comprise cooperating threads, and wherein the affixing comprises rotating the flotation disk to lock the flotation device in place.

7. The method of claim 1 further comprising removing the flotation device from the moved tubular.

* * * * *